US005240802A

United States Patent [19]

Molaire et al.

[11] Patent Number: 5,240,802

[45] Date of Patent: Aug. 31, 1993

[54] AGGREGATE PHOTOCONDUCTIVE ELEMENT AND METHOD OF MAKING SAME

[75] Inventors: Michel F. Molaire, Rochester; Paul M. Borsenberger, Hilton; James H. Peters, Penfield, all of N.Y.

[73] Assignee: Eastman Kodak Company, Rochester, N.Y.

[21] Appl. No.: 816,401

[22] Filed: Dec. 31, 1991

[51] Int. Cl.[5] ..... G03G 5/09; G03G 5/06; G03G 5/147

[52] U.S. Cl. ..... 430/67; 430/75; 430/83; 430/134

[58] Field of Search ..... 430/67, 75, 83, 134

[56] References Cited

U.S. PATENT DOCUMENTS

| | | | |
|---|---|---|---|
| 3,615,396 | 10/1971 | Gramza et al. | 430/83 |
| 3,615,414 | 10/1971 | Light | 430/74 |
| 3,615,415 | 10/1971 | Gramza . | |
| 3,679,408 | 7/1972 | Kryman et al. . | |
| 3,732,180 | 5/1973 | Gramza et al. . | |
| 4,329,416 | 5/1982 | Tanikawa et al. | 430/133 |
| 4,350,751 | 9/1982 | Contois | 430/135 |
| 4,477,549 | 10/1984 | Fujimaki et al. | 430/54 |
| 4,804,607 | 2/1989 | Atsumi | 430/67 |
| 4,868,078 | 9/1989 | Sakai et al. | 430/67 |

FOREIGN PATENT DOCUMENTS

| | | |
|---|---|---|
| 58-059454A | 4/1983 | Japan . |
| 59-229565A | 12/1984 | Japan . |
| 62-231264A | 10/1987 | Japan . |
| 63-081366A | 4/1988 | Japan . |

*Primary Examiner*—Roland Martin

*Attorney, Agent, or Firm*—Nixon, Hargrave, Devans & Doyle

[57] ABSTRACT

A photoconductive element of smooth surface comprises a single aggregate photoconductive layer which contains an aggregate photoconductor and at least three organic charge transport agents. In a preferred embodiment the aggregate photoconductive composition is formed from a high molecular weight alkylidene diarylene polycarbonate and is mixed with at least five organic charge transport agents and the element is overcoated with a thin, smooth, abrasion-resistant layer of silicon carbide. The smooth surface of the photoconductive element has a 20° gloss greater than about 6 and is resistant to scumming by fine toner particles.

12 Claims, 1 Drawing Sheet

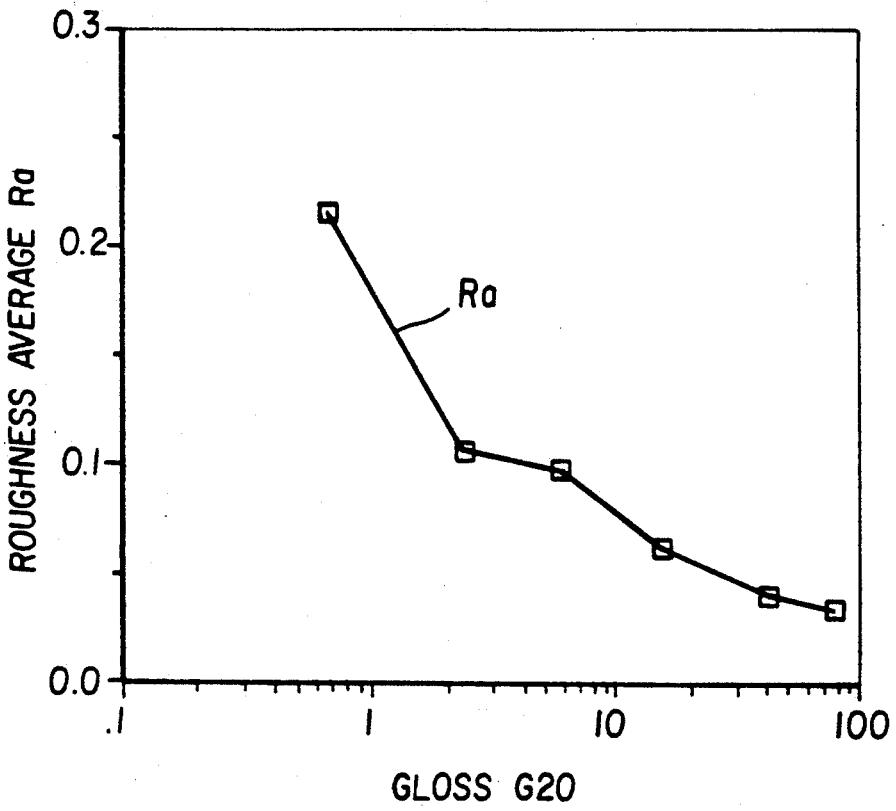
0.3
0.2
0.1
0.0
ROUGHNESS AVERAGE Ra
Ra
.1
1
10
100
GLOSS G20

AGGREGATE PHOTOCONDUCTIVE ELEMENT AND METHOD OF MAKING SAME

FIELD OF THE INVENTION

This invention relates to a novel photoconductive element containing a single aggregate photoconductive layer having a smooth surface and more particularly to such an element having a hard protective surface layer, and to methods for making such elements.

BACKGROUND OF THE INVENTION

Photoconductive elements, also called photoreceptors, are composed of a conducting support and at least one photoconductive layer which is insulating in the dark but which becomes conductive upon exposure to actinic radiation. To form images, the surface of the element is electrostatically uniformly charged in the dark and then exposed to a pattern of actinic radiation. In areas where the photoconductive layer is irradiated, mobile charge carriers are generated which migrate to the surface and dissipate the surface charge in such areas. The resulting charge pattern on the surface is referred to as an electrostatic latent image. The latent image can be made visible by application of a liquid or dry developer containing finely divided charged toner particles which, if desired, can be transferred and fixed to another surface such as a sheet of paper.

Numerous photoconductive materials have been described as being useful in electrophotography. These include inorganic substances, such as selenium and zinc oxide, and organic compounds, both monomeric and polymeric, such as arylamines, arylmethanes, carbazoles, pyrroles, phthalocyanines and the like. Especially useful are aggregate photoconductive compositions that have a continuous electrically insulating polymer phase containing a finely divided, particulate co-crystalline complex of at least one pyrylium-type dye salt and at least one polymer having an alkylidenediarylene group in a recurring unit.

Aggregate compositions used in photoreceptors can be prepared by several techniques, such as, for example, the "dye first" technique described in Gramza et al., U.S. Pat. No. 3,615,396. Alternatively, they can be prepared by the "shearing" method described in Gramza, U.S. Pat. No. 3,615,415. This latter method involves the high speed shearing of the photoconductive composition prior to coating and thus eliminates subsequent solvent treatment, as was disclosed in Light, U.S. Pat. No. 3,615,414. By whatever method prepared, the aggregate composition is applied with a suitable liquid coating vehicle onto a support or underlying layer to form a separately identifiable multiphase aggregate composition, the heterogeneous nature of which is generally apparent when viewed under magnification, although such compositions may appear to be uniform to the naked eye in the absence of magnification. There can, of course, be macroscopic heterogeneity. Suitably, the pyrylium type dye-salt-containing aggregate in the discontinuous phase is finely-divided, i.e., typically predominantly in the size range of from about 0.01 to about 25 $\mu$m.

Photoconductive elements can comprise single or multiple active layers. In a single layer photographic element charge generation and charge transport take place within the same layer. Single active layer aggregate photoconductive elements are described in Light, U.S. Pat. No. 3,615,414 and in Gramza et al., U.S. Pat. Nos. 3,732,180 and 3,615,415. Contois and Rossi, U.S. Pat. Nos. 3,873,312 and 3,873,311, describe the use of aggregate photoconductive compositions and elements containing organic photoconductors with a styrylamino structure. Berwick et al., U.S. Pat. No. 4,175,960, describe a multi-active photoconductive element having an aggregate charge generation layer.

Single active layer aggregate photoconductive compositions have found many commercial applications. They are easily and inexpensively manufactured and are especially suited for use in a drum format. They have the additional advantage of being able to photoconduct to either a negatively or positively charged surface.

A property of aggregate photoconductive compositions that is disadvantageous under certain circumstances is that, when employed as single active layer photoconductors, the layers characteristically have a rough surface. The demand for increasingly higher resolution requires toners with very fine particles. Residual toner, especially that of fine particle size, as well as other materials such as paper powder, accumulate on the rough aggregate layer surface, causing scumming after repeated use. This in turn results in images of poor quality.

This problem of scumming caused by the surface roughness of single active layer aggregate photoconductors can be overcome by the use of a charge-transport surface layer coated over the rough aggregate photoconductive layer. However such multiple active layer aggregate photoconductors are more difficult and expensive to manufacture than single active layer photoconductors.

U.S. Pat. No. 4,626,487 describes, as a solution to the problem of scumming, a developer which contains inorganic fine particles that scrape off residual toner as well as other materials from the photoconductor surface. However, because the aggregate layers containing organic charge transport agents are relatively soft, they are highly susceptible to scratching by the hard inorganic scraper particles. The resulting abrasion damage causes the production of defective copies after relatively low usage. A need exists for a low-cost single active layer photoconductor that is resistant to scumming and that, preferably, is abrasion-resistant.

BRIEF SUMMARY OF THE INVENTION

The single active layer aggregate photoconductive elements of the invention are smooth, which minimizes the scumming or accumulation of fine toner particles and other materials on the surface of the photoconductor. This smoothness of the photoconductive layer is maintained, in accordance with a preferred embodiment of the invention, by the application of a thin smooth protective overcoat of silicon carbide. This overcoat prevents the aggregate photoconductive layer from abrasion by inorganic scraper particles contained in the electrophotographic developer. As a consequence excellent copies can be produced even after repeated use of the photoconductive element. In addition to providing abrasion resistance, the overcoat of silicon carbide also filters out ultraviolet and visible radiation from the corona discharge, further prolonging the useful life of the aggregate photoconductive layer.

The photoconductive element of the invention comprises a single photoconductive layer on an electrically conductive support wherein said photoconductive layer comprises an aggregate photoconductive material comprising a continuous electrically insulating polymer phase and heterogeneously dispersed therein a complex of at least one polymer having an alkylidenediarylene group in a recurring unit and at least one pyrylium dye salt at a total concentration of no greater than 6 weight percent of the aggregate material, and at least three organic charge transport agents, said element having a surface with a 20° gloss measurement value greater than about 6.

In a preferred embodiment the above described photoconductive element additionally comprises a thin smooth overcoat of silicon carbide, approximately 0.1 to 0.3 μm in thickness.

The method of forming the photoconductive element having a single aggregate photoconductive layer on an electrically conductive support comprises forming a mixture comprising an aggregate photoconductive seed composition, one or more binder polymers, at least one of which is an aggregating polycarbonate, an aggregating pyrylium salt, at least three organic charge transport agents, a coating aid, and a volatile coating solvent, and coating and drying this mixture on the support. In the method of the invention, the concentration of the seed composition, which contains a small amount of preformed aggregate that provides nucleating sites for the formation of the dye-polymer aggregate composition, is from about 0.5 to 5.0 weight percent of the mixture, preferably greater than 1.5 weight percent.

It has been found, in accordance with the invention, that the molecular weight of the aggregating binder unexpectedly affects the smoothness of the single aggregate photoconductive layer. The aggregating binder is a high molecular weight polycarbonate having a number average molecular weight of at least about 100,000 polystyrene equivalents and, preferably, at least about 150,000 polystyrene equivalents.

In accordance with the invention, the use of multiple organic charge transport agents in a single formulation unexpectedly promotes the formation of a smooth single aggregate photoconductive layer. At least 3, and preferably 5 or more, different organic charge transport agents are used in the aggregate photoconductive compositions of the invention.

Also in accordance with the invention, the concentration of aggregating pyrylium dye salts unexpectedly affects the smoothness of the single aggregate photoconductive layer. The total dye concentration is preferably no greater than about 6 weight percent and, preferably no greater than about 4 weight per cent of the mixture.

BRIEF DESCRIPTION OF THE DRAWINGS

The FIGURE is a diagram showing the relationship between roughness average, as measured by profilometry, and 20° gloss values, as measured by a Glossard II gloss meter.

DETAILED DESCRIPTION OF THE INVENTION

As used herein, the following terms have the meanings indicated:

An "aggregate photoconductive material" is a material containing a finely divided, particulate photoconductive co-crystalline complex of at least one aggregating dye salt and at least one aggregating binder polymer.

An "aggregating dye" is a dye salt, preferably of the pyrylium type, that forms a photoconductive co-crystalline complex with an aggregating binder polymer.

An "aggregating binder polymer" is a polymer having an alkylidenediarylene repeating unit, preferably a polycarbonate, that forms a photoconductive co-crystalline complex with an aggregating dye.

A "seed composition" is a composition containing small preformed dye-polymer aggregate particles that are nucleating sites for the formation of a particulate photoconductive co-crystalline complex of aggregating dye salt and aggregating binder polymer.

In the manufacture of the photoconductive elements of the invention, a specifically prepared aggregate photoconductive composition is coated and dried on an electrically conductive substrate. The latter can be in the form of a plate, sheet or web, but most advantageously in accordance with the invention, is a cylindrical drum, for example, a metallic drum or a nonmetallic drum that has an electrically conductive surface.

In preparing the aggregate composition in the method of the invention, one or more binder polymers, at least one of which is an aggregating polymer, are dissolved in an organic solvent. To this mixture is added a seed composition, which contains small preformed aggregate particles that are nucleating sites for the formation of the dye-polymer aggregate composition. To the resulting mixture are added selected aggregating dyes, organic charge transport agents and, preferably, a coating aid.

The aggregate compositions of the invention, which yield smooth photoconductive layers, are prepared with an aggregating binder polymer, preferably a high molecular weight polycarbonate having a number average molecular weight of at least about 100,000 polystyrene equivalents, preferably at least about 150,000 polystyrene equivalents, and about 0.5 to 5.0 weight percent of seed. The compositions of the invention additionally contain no greater than 6 weight percent total, preferably no greater than 4 weight percent total, of one or more aggregating pyrylium salt dyes and at least three and, preferably, at least five organic charge transport agents.

Pyrylium type dye salts, especially thiapyrylium and selenapyrylium dye salts, are useful in forming the aggregate compositions. Useful dyes are disclosed in Light, U.S. Pat. No. 3,615,414.

Particularly useful in forming the aggregates are pyrylium dye salts having the formula:

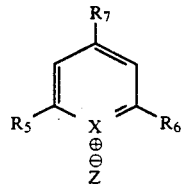

wherein:

$R_5$ and $R_6$ are phenyl groups;

$R_7$ is a dimethylaminosubstituted phenyl group;

X is a selenium, sulfur or tellurium; and

Z is an anion such as perchlorate, tetrafluoroborate or hexafluorophosphate.

The polymers useful in forming the aggregate compositions are electrically insulating, film-forming polymers having an alkylidenediarylene group in a recurring unit such as those linear polymers disclosed in Light, U.S. Pat. No. 3,615,414 and Gramza et al., U.S. Pat. No. 3,732,180, which are incorporated herein by reference.

Preferred polymers for forming aggregate compositions are hydrophobic carbonate polymers containing the following group in a recurring unit:

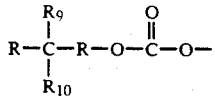

wherein each R is a phenylene group; and $R_9$ and $R_{10}$ are each methyl or, taken together, represent a norbornyl group. Such compositions are disclosed, for example, in U.S. Pat. Nos. 3,028,365 and 3,317,466. Especially preferred are polycarbonates prepared with bisphenol A. A wide range of film-forming polycarbonate resins are useful, satisfactory results being obtained when using commercial polymeric materials that are characterized by an inherent viscosity of about 0.5 to about 1.8. Specific examples of useful polymers for the aggregate compositions are listed in Table I, Column 13 of U.S. Pat. No. 4,108,657, incorporated herein by reference.

Preferred organic charge transport agents are triarylamines such as tri-p-tolylamine and aminosubstituted polyarylalkane compounds represented by the formula;

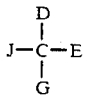

wherein D and G, which may be the same or different, represent aryl groups and J and E, which may be the same or different, represent a hydrogen atom, an alkyl group, or an aryl group, at least one of D, E and G containing an amino substituent. Especially useful is a polyarylalkane wherein J and E represent a hydrogen atom, an aryl, or an alkyl group and D and G represent substituted aryl groups having as a substituent thereof a diarylamino group wherein the aryl groups are unsubstituted aryl groups such as tolyl. Additional information concerning certain of these latter polyarylalkanes can be found in Rule et al., U.S. Pat. No. 4,127,412.

The aggregate composition of the invention is filtered and coated on a substrate. Any technique for coating these uniform layers on a substrate can be used. When the substrate is a flat surface such as a sheet, plate or web, suitable coating methods include extrusion hopper coating, curtain coating, reverse roll coating and the like. For coating a drum substrate, a ring coater advantageously is used. After coating, the photoconductive layer on the substrate is dried, for example, by heating in an oven at a temperature from about 80° C. to about 110° C.

The smoothness of the single aggregate photoconductive layer of the invention is also affected by the dew point conditions under which coating is carried out. Higher dew points tend to reduce smoothness. Therefore it is desirable to maintain the dew point below about −4° C. during coating.

The surface smoothness of a single aggregate photoconductive layer can be evaluated by measuring its gloss, using, for example, a "Glossard II" 20 degree gloss meter, manufactured by the Pacific Scientific Company. Good correlation has been found between gloss measurement value and surface smoothness, as evaluated by electron microscopy. It is quite difficult and time consuming to conduct electron microscopic measurements on a cylindrical photoconductor drum. Thus, gloss determinations are used as a measure of surface smoothness of the novel photoconductive elements. The measurements were done by tilting the Glossard II device, at various angles, while it is sitting on the drum surface, until the highest reading is obtained. With flat film, there is no need for tilting the measuring device.

The direct way of looking at surface smoothness (surface roughness), is to measure the roughness average Ra by techniques such as profilometry. As can be seen in the Figure, a good correlation has been found between roughness average, Ra, and measured gloss.

The thin smooth silicon carbide overcoat of the preferred embodiment is applied by plasma deposition of a mixture of silane, hydrogen, methane, and helium at low temperature, approximately 50° C. The initial smoothness of the photoconductive layer is not changed by the application of the silicon carbide overcoat, which has a thickness of about 0.1 μm to about 0.3 μm.

The following examples further describe the invention:

All the formulations of the examples for the aggregate photoconductive layers were prepared at room temperature. The aggregating dyes were first dissolved in the solvent mixture; the binding polymers and organic charge transport agents were then added. After all the materials were in solution, the seed was added. A phenylmethylsubstituted siloxane with a viscosity of 50 centistokes ("DC-510" polysiloxane, obtained from Dow Corning, was used as a coating aid in all formulations. The resulting solutions were filtered first through a 2.5 μm, then through a 0.6 μm filter.

The formulations used in the examples are listed in Tables I, II, III, and IV. The formulations in Table I, II, and III were all coated on an electroconductive web support. Table I contains formulations in which the concentration of seed and the molecular weight of the aggregating binder were varied. Table II lists formulations in which the concentration of the aggregating dyes and the number of organic charge transport agents were varied. Table III lists formulations containing varying amounts of submicron particles of titanyl fluorophthalocyanine (U.S. Pat. No. 4,701,396), a pigment that extends the sensitivity of the photoconductive layer into the infrared region. Table IV contains photoconductive layers that were coated on aluminum drums.

The seed used in the formulations listed in Tables I, II, III and IV was prepared as follows:

To a mixture of 1155 grams of dichloromethane and 493.5 grams of 1,1,2-trichloroethane was added 8.04 grams of 4-((4-dimethylaminophenyl)2,6-diphenyl)6-phenylthiapyryli um tetrafluoroborate and 5.36 grams of 4-(4-dimethylaminophenyl)-2-(4-ethoxyphenyl)-6-phenylthia pyrylium tetrafluoroborate. The mixture was stirred mechanically for one hour; to the resulting solution was added 102 grams of high molecular weight Bisphenol A polycarbonate. After one hour additional stirring, 238 grams of low molecular weight Bisphenol A polycarbonate was added. The mixture was stirred overnight, then diluted with 211.5 grams of 1,1,2-trichloroethane. The resulting slurry was allowed to evaporate to dryness, and the residue was cut into small pieces. The high molecular weight polycarbonate referred to above and in the examples hereinafter was "Makrolon 5705" polycarbonate, obtained from Mobay Chemical Co. Its number average molecular weight, as determined by gel permeation chromatography, was 178,000 polystyrene equivalents. The low molecular weight polycarbonate referred to above and in the following examples was "Lexan 145" polycarbonate, obtained from General Electric Co. Its number average molecular weight, as determined by gel permeation chromatography, was 51,600 polystyrene equivalents.

EXAMPLE 1

Formulation I-1 contained equal amounts by weight of the low molecular weight polycarbonate aggregating binder and the non-aggregating binder, tetrachlorobisphenol A polycarbonate, and approximately 2 weight percent of seed. It was coated at a controlled dew point of −7° C. (20° F.). After drying, the coating had a 20° gloss measurement of 9.8, as measured by the "Glossard II" meter.

Formulation I-2 was identical to I-1, except that an equal amount of the high molecular weight polycarbonate binder was substituted for the low molecular weight polycarbonate. The measured gloss from the dried coating containing formulation I-2 was 19, demonstrating the improved smoothness resulting from use of the high molecular weight binder.

EXAMPLE 2

In the same manner as described in Example 1, formulation I-3, differing from I-1 only in containing a higher concentration of seed, approximately 3 weight percent, gave a coating with a 20° gloss value of 6.4. Formulation I-4, also containing 3 percent seed but high molecular weight polycarbonate in place of low molecular weight polycarbonate, yielded a coating with a gloss of 45.4. As was observed in Example 1, the coating containing the high molecular weight aggregating binder had the greater smoothness.

EXAMPLE 3

Formulations I-5, containing 4 weight percent of seed and low molecular weight polycarbonate as the aggregating binder, and I-6, also containing 4 percent seed but high molecular weight polycarbonate as binder, were coated as described in Example 1. Gloss measurements were 2 for the coating containing low molecular weight polycarbonate, 23 for the coating containing high molecular weight polycarbonate. Thus, as observed in the two previous examples, the inclusion of high in place of low molecular weight polycarbonate resulted in a coating of high smoothness. In addition, the coatings containing either of the aggregating binders and 4 weight percent of seed exhibited lower gloss than corresponding coatings containing a lower level of seed.

EXAMPLE 4

Formulations II-1, II-2, and II-3, all containing a mixture of low and high molecular weight polycarbonates in a 1:1 weight ratio and approximately 4 weight percent of the same aggregating dyes, were coated as described in Example 1. These formulations differed only in the number of organic charge transport agents, 3, 4, 5 respectively, they contained, but the total percent by weight was the same in all cases. The coating of II-1, which contained 3 organic charge transport agents, had a 20° gloss value of 2; the coating of II-2, with 4 organic charge transport agents, had a gloss of 8; the coating of II-3, with 5 organic charge transport agents, had a gloss of 11. Thus there was a steady improvement in coating smoothness as the number of organic charge transport agents increased from 3 to 4 to 5.

EXAMPLE 5

Formulations II-4, II-5, and II-6, containing the same levels of low and high molecular weight polycarbonates and the same total concentration of organic charge transport agents as those of Example 4, were coated as described in Example 1. II-4, II-5, and II-6, however, contained a decreased level, approximately 3 weight percent, of aggregating dyes, and differed among themselves in the number of organic organic charge transport agents included, 3, 4, and 5 respectively. The coating of II-4, with 3 organic charge transport agents, had a 20° gloss value of 9; the II-5 coating, with 4 organic charge transport agents, had a similar gloss value, 8. The coating of II-6, with 5 organic charge transport agents, was the smoothest, with a gloss of 17. Comparison of these results with those of Example 4 shows that the use of the lower concentration of aggregating dyes generally resulted in improved smoothness.

EXAMPLE 6

Formulation III-1, which contained high molecular weight polycarbonate as the aggregating binder, 1.98 weight percent of aggregating dyes, 2.96 weight percent of seed, and a mixture of 4 organic charge transport agents, was coated as described in Example 1. The coating of III-1, which serves as a comparison for the coatings of Examples 7 and 8 following, gave a high 20° gloss value, 43.

EXAMPLE 7

Formulation III-2, contained high molecular weight polycarbonate as binder, 3.61 weight percent of aggregating dyes, 2.71 weight percent of seed, the same composition of 4 organic charge transport agents as III-1, and 3.45 weight percent of submicron particles of the pigment titanyl fluorophthalocyanine. This formulation, coated as described in Example 1, gave a coating with a gloss of 17. Although this value was lower than that obtained in Example 6, it demonstrated that good surface smoothness could be obtained with coatings containing submicron pigment particles.

EXAMPLE 8

Formulation III-3, containing high molecular weight polycarbonate, 2.74 weight percent of aggregating dyes, 2.73 weight percent of seed, the same composition of 4 organic charge transport agents as III-1 and III-2, and 3.48 weight percent of titanyl fluorophthalocyanine particles, was coated as described in Example 1. A coating with a 20° gloss value of 28 was obtained. This gloss, which was higher than that shown by the coating of Example 7, probably because of the lower level of aggregating dyes in III-3 compared to III-2, further demonstrated the high surface smoothness attainable with coatings containing very fine pigment particles.

DRUM COATINGS

Several formulations for aggregate photoconductive layers were coated, using a ring coater mounted with a Teflon® gasket over 108 mm diameter aluminum drums. The formulations used for these coatings are listed in Table IV.

After drying and cooling, the drum coatings were generally overcoated with a thin (0.1–0.3 μm) film of silicon carbide, produced by plasma deposition under the following conditions:

| | |
|---|---|
| Substrate temperature: | 50° C. |
| Plasma power: | 30 mwatts/cm$^2$ |
| Plasma frequency: | 40 KHz |
| Pressure: | 2 Torr |
| Gas flow: | 300 SCCM* |
| Gas mixture: | $H_2$, $SiH_4$, $CH_4$, He |

*SCCM = cubic centimeters per minute at standard temperature and pressure

The mixture of gases was obtained by combining a 90:10 mixture of $H_2$ and $SiH_4$, and a 75:25 mixture of (He and $CH_4$. The flow rates of the two gas mixtures were adjusted to yield a 19:1 $CH_4$–$SiH_4$ ratio.

EXAMPLE 9

Formulation IV-1, which contained non-aggregating tetrachlorobisphenol A polycarbonate and high molecular weight polycarbonate aggregating binder, 0.48 weight percent seed, 3.80 weight percent aggregating dyes, and a mixture of 4 organic charge transport agents, was coated at a machine speed of 0.76 cm/sec (0.3 in/sec) and a dew point of approximately −4° C. The drum was dried in an oven in two stages, first for 15 minutes at 110° C., then, after cooling at room temperature for 2 hours, for one hour at 110° C. The drum was again cooled and overcoated with silicon carbide. The 20° gloss measurement for the drum thus prepared was 2.4.

The drum was mounted on a commercial Eastman Kodak Company EK-90 electrophotographic copier. The developer used in that machine was Kodak Monocomponent 90 toner, which contains pigmented thermoplastic polymer and inorganic scraper particles. Examination of the drum revealed a white residue after only 18 copies. The rough surface of the drum coating, as measured by the low gloss value, resulted in serious contamination after very low usage.

EXAMPLE 10

Formulation IV-2, which was similar in composition to IV-1 except that it contained the high molecular weight polycarbonate as the only binder, was coated and dried as described in Example 9. After overcoating with silicon carbide, the 20° gloss value measured for the drum was 4.3.

The drum was evaluated for toner contamination as described in Example 9. A white powdery residue was observed after 500 copies and increased after 1000 copies. A significant sensitivity loss was also observed. The low smoothness of the drum resulted in considerable contamination after relatively low usage.

EXAMPLE 11

Formulation IV-3, which contained equal amounts of non-aggregating tetrachlorobisphenol A polycarbonate and low molecular weight polycarbonate aggregating binder, together with 1.96 weight percent seed, 3.91 weight percent aggregating dyes, and a mixture of 5 organic charge transport agents, was coated at a machine speed of 1.0 cm/sec (0.4 in/sec) and a dew point of approximately −4° C. The drum was dried for one hour at 110° C., then cooled and overcoated with silicon carbide. The 20° gloss measurement for the drum thus prepared was 5.9.

The drum was evaluated for toner contamination as in Example 9. The drum was evenly coated with a white powdery residue after 200 copies, and a loss of density and quality was observed. The relatively low smoothness of the coating, the consequence of using low molecular weight polycarbonate as the aggregating binder, resulted in considerable contamination after relatively low usage.

EXAMPLE 12

Formulation IV-4, which contained equal amounts of non-aggregating tetrachlorobisphenol A and high molecular weight polycarbonate, 0.50 weight percent seed, 3.01 weight percent aggregating dyes, and a mixture of 5 organic charge transport agents, was coated and dried as described in Example 11. After overcoating with silicon carbide, the measured 20° glass value was 8.5.

The drum was evaluated for toner contamination as described in Example 9. No contamination was observed after 1000 copies. The high smoothness of this drum, as measured by its gloss value of 8.5, accounts for this lack of contamination.

EXAMPLE 13

Formulation IV-5, which was similar to IV-4 except that the level of aggregating dyes was increased to 3.97 weight percent, was coated and dried as described in Example 11. After overcoating with silicon carbide, the measured 20° gloss value was 10.4.

The drum was evaluated for toner contamination as described in Example 9. Although some stripe defects were observed after 500 copies, these diminished with continued operation and had disappeared at 2000 copies, with no contamination evident. The good performance of this drum in the contamination test was consistent with its high degree of smoothness.

EXAMPLE 14

Formulation IV-6, which was similar to IV-5 except that the level of seed was increased to 2.91 weight percent (from 0.5 percent), was coated and dried as described in Example 11. The measured gloss value of the silicon carbide-overcoated drum was 23.

This drum was evaluated for toner contamination as described in Example 9. Although a few stripe defects were noticed after 1000 copies, no toner contamination was observed after 3000 copies. These excellent results were consistent with the very high smoothness of this coating.

EXAMPLE 15

Formulation IV-6, also used in Example 14, was coated and dried as described in Example 11, except that the machine coating speed was ⅓ cm/sec (0.5 in/sec). The 20° gloss value of the drum after application of the silicon carbide overcoat was 22.

This drum was evaluated as described in Example 9. The test was run for 170,000 copies. Although stress lines and uneven wear patterns were eventually observed, no deterioration of the drum surface or contamination by toner was observed after 31,000 copies. This excellent performance after such extended usage demonstrates the advantage of the very smooth coating for avoiding toner contamination and of the silicon carbide overcoat for protecting the surface of the drum.

EXAMPLE 16

Formulation IV-7, which contained high molecular weight polycarbonate as the only binder, together with 0.50 weight percent seed, 3.97 weight percent aggregating dyes, and a mixture of 3 organic charge transport agents, was coated at a machine speed of 0.76 cm/sec (0.3 in/sec) and a dew point of approximately −4° C. The coating was dried for 30 minutes at 100° C., cooled, and overcoated with silicon carbide. No gloss measurement was made on the drum.

The drum was tested as described in Example 9. It was run for 10,000 copies. At the conclusion of the test the drum surface was examined microscopically. No scratches could be detected on the surface of the drum, demonstrating the protection of the drum surface by the silicon carbide overcoat.

EXAMPLE 17

Formulation IV-7 was coated according to the procedure described in Example 16, except that no silicon carbide overcoat was applied. The resulting drum was tested as described in Example 9. After a run of 10,000 copies, damage to the drum surface was apparent from the printing artifacts produced on the copies. In contrast to the results of Example 16, microscopic examination of the surface of the drum revealed substantial scratching, the result of abrasion of the unprotected photoconductive layer by the scraper particles in the toner.

The invention has been described in detail with particular reference to preferred embodiments thereof, but it will be understood that variations and modifications can be effected within the spirit and scope of the invention.

TABLE I

Variation of Seed Concentration and Aggregating Binder Molecular Weight

| | −1 | | −2 | | −3 | |
|---|---|---|---|---|---|---|
| | Grams | Wt % | Grams | Wt % | Grams | Wt % |
| Tetrachloro-bisphenol A polycarbonate | 29.70 | 26.42 | 29.70 | 26.42 | 29.70 | 26.17 |
| "Lexan 145" polycarbonate | 29.70 | 26.42 | 0 | 0 | 29.70 | 26.17 |
| "Makrolon 5705" polycarbonate | 0 | 0 | 29.70 | 26.42 | 0 | 0 |
| Seed | 2.20 | 1.96 | 2.20 | 1.96 | 3.30 | 2.91 |
| Polyester of DMT/EG/NPG* | 2.20 | 1.96 | 2.20 | 1.96 | 2.20 | 1.94 |
| 4-((4-Dimethyl-aminophenyl)2,6-di phenyl) 6-phenyl-thiapyrylium hexafluorophosphate | 3.52 | 3.13 | 3.52 | 3.13 | 3.52 | 3.10 |
| 4-(4-Dimethyl-aminophenyl)2-(4-ethoxyphenyl) 6-phenyl-thiapyrylium tetrafluoroborate | 0.88 | 0.78 | 0.88 | 0.78 | 0.88 | 0.78 |
| Tri-4-tolylamine | 9.90 | 8.81 | 9.90 | 8.81 | 9.90 | 8.72 |
| 1,1-Bis(di-4-tolyl-aminophenyl) cyclohexane | 9.90 | 8.81 | 9.90 | 8.81 | 9.90 | 8.72 |
| 1,4-Bis(di-4-tolyl-aminostyryl)benzene | 9.90 | 8.81 | 9.90 | 8.81 | 9.90 | 8.72 |
| 1,1-Bis(di-4-tolyl-aminophenyl) 3-n-propylbenzene | 9.90 | 8.81 | 9.90 | 8.81 | 9.90 | 8.72 |
| 4,4'-Bis(diethylamino) tetraphenylmethane | 4.40 | 3.91 | 4.40 | 3.91 | 4.40 | 3.88 |
| DC-510, phenylmethyl substituted siloxane | 0.20 | 0.18 | 0.20 | 0.18 | 0.20 | 0.17 |
| Dichloromethane | 623 | | 623 | | 623 | |
| 1,1,2-Trichloroethane | 267 | | 267 | | 267 | |
| Total Solids | 112.40 | 11.21 | 112.40 | 11.21 | 113.50 | 11.31 |

TABLE I-continued

Variation of Seed Concentration and Aggregating Binder Molecular Weight

| | −4 | | −5 | | −6 | |
|---|---|---|---|---|---|---|
| | Grams | Wt % | Grams | Wt % | Grams | Wt % |
| Tetrachloro-bisphenol A polycarbonate | 29.70 | 26.17 | 29.70 | 26.17 | 29.70 | 25.92 |
| "Lexan 145" polycarbonate | 0 | 0 | 29.70 | 25.92 | 0 | 0 |
| "Makrolon 5705" polycarbonate | 29.70 | 26.17 | 0 | 0 | 29.70 | 25.92 |
| Seed | 3.30 | 2.91 | 4.40 | 3.84 | 4.40 | 3.84 |
| Polyester of DMT/EG/NPG* | 2.20 | 1.94 | 2.20 | 1.92 | 2.20 | 1.92 |
| 4-((4-Dimethyl-aminophenyl)2,6-di phenyl) 6-phenyl-thiapyrylium hexafluorophosphate | 3.52 | 3.10 | 3.52 | 3.07 | 3.52 | 3.07 |
| 4-(4-Dimethyl-aminophenyl)2-(4-ethoxyphenyl) 6-phenyl-thiapyrylium tetrafluoroborate | 0.88 | 0.78 | 0.88 | 0.78 | 0.88 | 0.78 |
| Tri-4-tolylamine | 9.90 | 8.72 | 9.90 | 8.64 | 9.90 | 8.64 |
| 1,1-Bis(di-4-tolyl-aminophenyl) cyclohexane | 9.90 | 8.72 | 9.90 | 8.64 | 9.90 | 8.64 |
| 1,4-Bis(di-4-tolyl-aminostyryl)benzene | 9.90 | 8.72 | 9.90 | 8.64 | 9.90 | 8.64 |
| 1,1-Bis(di-4-tolyl-aminophenyl) 3-n-propylbenzene | 9.90 | 8.72 | 9.90 | 8.64 | 9.90 | 8.64 |
| 4,4'-Bis(diethylamino) tetraphenylmethane | 4.40 | 3.88 | 4.40 | 3.84 | 4.40 | 3.84 |
| DC-510, phenylmethyl substituted siloxane | 0.20 | 0.17 | 0.20 | 0.17 | 0.20 | 0.17 |
| Dichloromethane | 623 | | 623 | | 623 | |
| 1,1,2-Trichloroethane | 267 | | 267 | | 267 | |
| Total Solids | 113.50 | 11.31 | 114.60 | 11.41 | 114.60 | 11.41 |

*Dimethyl terephthalate - ethyleneglycol - neopentylglycol

TABLE II

Variation of Dye Concentration and Number of Organic Charge Transport Agents

| | −1 | | −2 | | −3 | |
|---|---|---|---|---|---|---|
| | Grams | Wt % | Grams | Wt % | Grams | Wt % |
| Tetrachloro-bisphenol A polycarbonate | 0 | 0 | 0 | 0 | 0 | 0 |
| "Lexan 145" polycarbonate | 29.70 | 26.82 | 29.70 | 26.82 | 29.70 | 26.82 |
| "Makrolon 5705" polycarbonate | 29.70 | 26.82 | 29.70 | 26.82 | 29.70 | 26.82 |
| Seed | 0.55 | 0.50 | 0.55 | 0.50 | 0.55 | 0.50 |
| Polyester of DMT/EG/NPG* | 2.20 | 1.99 | 2.20 | 1.99 | 2.20 | 1.99 |
| 4-((4-Dimethyl-aminophenyl)2,6-di phenyl) 6-phenyl-thiapyrylium hexafluorophosphate | 3.52 | 3.18 | 3.52 | 3.18 | 3.52 | 3.18 |
| 4-(4-Dimethyl- | 0.88 | 0.79 | 0.88 | 0.79 | 0.88 | 0.79 |

TABLE II-continued

Variation of Dye Concentration and Number of Organic Charge Transport Agents

| | | | | | | |
|---|---|---|---|---|---|---|
| aminophenyl)2-(4-ethoxyphenyl) 6-phenyl-thiapyrylium tetrafluoroborate | | | | | | |
| Tri-4-tolylamine | 19.80 | 17.88 | 14.85 | 13.41 | 9.90 | 8.94 |
| 1,1-Bis(di-4-tolyl-aminophenyl) cyclohexane | 19.80 | 17.88 | 14.85 | 13.41 | 9.90 | 8.94 |
| 1,4-Bis(di-4-tolyl-aminostyryl)benzene | 0 | 0 | 9.90 | 8.94 | 9.90 | 8.94 |
| 1,1-Bis(di-4-tolyl-aminophenyl) 3-n-propylbenzene | 0 | 0 | 0 | 0 | 9.90 | 8.94 |
| 4,4'-Bis(diethylamino) tetraphenylmethane | 4.40 | 3.97 | 4.40 | 3.97 | 4.40 | 3.97 |
| DC-510, | 0.20 | 0.18 | 0.20 | 0.18 | 0.20 | 0.18 |
| phenylmethyl substituted siloxane | | | | | | |
| Dichloromethane | 623 | | 623 | | 623 | |
| 1,1,2-Trichloroethane | 267 | | 267 | | 267 | |
| Total Solids | 110.75 | 11.07 | 110.75 | 11.07 | 110.75 | 11.07 |

| | −4 | | −5 | | −6 | |
|---|---|---|---|---|---|---|
| | Grams | Wt % | Grams | Wt % | Grams | Wt % |
| Tetrachloro-bisphenol A polycarbonate | 0 | 0 | 0 | 0 | 0 | 0 |
| "Lexan 145" polycarbonate | 29.70 | 27.09 | 29.70 | 27.09 | 29.70 | 27.09 |
| "Makrolon 5705" polycarbonate | 29.70 | 27.09 | 29.70 | 27.09 | 29.70 | 27.09 |
| Seed | 0.55 | 0.50 | 0.55 | 0.50 | 0.55 | 0.50 |
| Polyester of DMT/EG/NPG* | 2.20 | 2.01 | 2.20 | 2.01 | 2.20 | 2.01 |
| 4-((4-Dimethyl-aminophenyl)2,6-di phenyl) 6-phenyl-thiapyrylium hexafluorophosphate | 2.64 | 2.41 | 2.64 | 2.41 | 2.64 | 2.41 |
| 4-(4-Dimethyl-aminophenyl)2-(4-ethoxyphenyl) 6-phenyl-thiapyrylium tetrafluoroborate | 0.66 | 0.60 | 0.66 | 0.60 | 0.66 | 0.60 |
| Tri-4-tolylamine | 19.80 | 18.06 | 14.08 | 13.54 | 9.90 | 9.03 |
| 1,1-Bis(di-4-tolyl-aminophenyl) cyclohexane | 19.80 | 18.06 | 14.85 | 13.54 | 9.90 | 9.03 |
| 1,4-Bis(di-4-tolyl-aminostyryl)benzene | 0 | 0 | 9.90 | 9.03 | 9.90 | 9.03 |
| 1,1-Bis(di-4-tolyl-aminophenyl) 3-n-propylbenzene | 0 | 0 | 0 | 0 | 9.90 | 9.03 |
| 4,4'-Bis(diethylamino) tetraphenylmethane | 4.40 | 4.01 | 4.40 | 4.01 | 4.40 | 4.01 |
| DC-510, | 0.20 | 0.18 | 0.20 | 0.18 | 0.20 | 0.18 |
| phenylmethyl substituted siloxane | | | | | | |
| Dichloromethane | 623 | | 623 | | 623 | |
| 1,1,2-Trichloroethane | 267 | | 267 | | 267 | |
| Total Solids | 109.65 | 10.97 | 109.65 | 10.97 | 109.65 | 10.97 |

*Dimethyl terephthalate - ethyleneglycol - neopentylglycol

TABLE III

Inclusion of Submicron Pigment Particles

| | −1 | | −2 | | −3 | |
|---|---|---|---|---|---|---|
| | Grams | Wt % | Grams | Wt % | Grams | Wt % |
| Tetrachloro-bisphenol A polycarbonate | 14.85 | 26.68 | 14.85 | 24.36 | 14.85 | 24.59 |
| "Makrolon 5705" polycarbonate | 14.85 | 26.68 | 16.95 | 27.81 | 16.95 | 28.06 |
| Titanyl Fluoro-phthalocyanine | 0 | 0 | 2.10 | 3.45 | 2.10 | 3.48 |
| Seed | 1.65 | 2.96 | 1.65 | 2.73 | 1.65 | 2.71 |
| Polyester of DMT/EG/NPG* | 1.10 | 1.98 | 1.10 | 1.80 | 1.10 | 1.82 |
| 4-((4-Dimethyl-aminophenyl)2,6-di phenyl) 6-phenyl-thiapyrylium hexafluorophosphate | 0.88 | 1.58 | 1.76 | 2.89 | 1.32 | 2.19 |
| 4-(4-Dimethyl-aminophenyl)2-(4-ethoxyphenyl) 6-phenyl-thiapyrylium tetrafluoroborate | 0.22 | 0.40 | 0.44 | 0.72 | 0.33 | 0.55 |
| Tri-4-tolylamine | 0 | 0 | 0 | 0 | 0 | 0 |
| 1,1-Bis(di-4-tolyl-aminophenyl) cyclohexane | 7.15 | 12.85 | 7.15 | 11.73 | 7.15 | 11.84 |
| 1,4-Bis(di-4-tolyl-aminostyryl)benzene | 5.50 | 9.88 | 5.50 | 9.02 | 5.50 | 9.11 |
| 1,1-Bis(di-4-tolyl-aminophenyl) 3-n-propylbenzene | 7.15 | 12.85 | 7.15 | 11.73 | 7.15 | 11.84 |
| 4,4'-Bis(diethylamino) tetraphenylmethane | 2.20 | 3.95 | 2.20 | 3.61 | 2.20 | 3.64 |
| DC-510, | 0.10 | 0.18 | 0.10 | 0.16 | 0.10 | 0.17 |
| phenylmethyl substituted siloxane | | | | | | |
| Dichloromethane | 311.5 | | 311.5 | | 311.5 | |
| 1,1,2-Trichloroethane | 133.5 | | 133.5 | | 133.5 | |
| Total Solids | 55.65 | 11.12 | 60.95 | 12.05 | 60.40 | 11.95 |

*Dimethyl terephthalate - ethyleneglycol - neopentylglycol

TABLE IV

Formulations for Drum Coatings

| | −1 | | −2 | | −3 | | −4 | |
|---|---|---|---|---|---|---|---|---|
| | Grams | Wt % | Grams | Wt % | Grams | Wt % | Grams | Wt % |
| Tetrachlorobisphenol A polycarbonate | 31.90 | 27.60 | 0 | 0 | 29.70 | 26.42 | 29.70 | 27.09 |
| "Lexan 145" polycarbonate | 0 | 0 | 0 | 0 | 29.70 | 26.42 | 0 | 0 |
| "Makrolon 5705" polycarbonate | 31.90 | 27.60 | 46.50 | 55.21 | 0 | 0 | 29.70 | 27.09 |
| Seed | 0.55 | 0.48 | 0.40 | 0.48 | 2.20 | 1.96 | 0.55 | 0.50 |
| Polyester of DMT/EG/NPG* | 2.75 | 2.38 | 2.00 | 2.38 | 2.20 | 1.96 | 2.20 | 2.01 |
| 4-((4-Dimethylaminophenyl)2,6-di phenyl) 6-phenylthiapyrylium hexafluorophosphate | 3.52 | 3.04 | 2.56 | 3.05 | 3.52 | 3.13 | 2.64 | 2.41 |
| 4-(4-Dimethylaminophenyl)2-(4-ethoxyphenyl) | 0.88 | 0.76 | 0.64 | 0.76 | 0.88 | 0.78 | 0.66 | 0.60 |

TABLE IV-continued

| Formulations for Drum Coatings | | | | | | | | |
|---|---|---|---|---|---|---|---|---|
| 6-phenylthiapyrylium tetrafluoroborate | | | | | | | | |
| Tri-4-tolylamine | 14.30 | 12.37 | 10.40 | 12.38 | 9.90 | 8.81 | 9.90 | 9.03 |
| 1,1-Bis(di-4-tolyl-aminophenyl)cyclohexane | 14.30 | 12.37 | 10.40 | 12.38 | 9.90 | 8.81 | 9.90 | 9.03 |
| 1,4-Bis(di-4-tolyl-aminostyryl)benzene | 11.00 | 9.52 | 8.00 | 9.52 | 9.90 | 8.81 | 9.90 | 9.03 |
| 1,1-Bis(di-4-tolyl- aminophenyl) 3-n-propylbenzene | 0 | 0 | 0 | 0 | 9.90 | 8.81 | 9.90 | 9.03 |
| 4,4'-Bis(diethylamino) tetraphenylmethane | 3.20 | 3.81 | 4.40 | 3.81 | 4.40 | 3.91 | 4.40 | 4.01 |
| DC-510,phenylmethyl substituted siloxane | 0.10 | 0.09 | 0.04 | 0.05 | 0.20 | 0.18 | 0.20 | 0.18 |
| Dichloromethane | 623 | | 644 | | 623 | | 623 | |
| 1,1,2-Trichloroethane | 267 | | 276 | | 267 | | 267 | |
| Total Solids | 115.60 | 11.50 | 84.04 | 8.37 | 112.40 | 11.21 | 109.65 | 10.97 |

| | −5 | | −6 | | −7 | |
|---|---|---|---|---|---|---|
| | Grams | Wt % | Grams | Wt % | Grams | Wt % |
| Tetrachlorobisphenol A polycarbonate | 29.70 | 26.82 | 29.70 | 26.17 | 0 | 0 |
| "Lexan 145" polycarbonate | 0 | 0 | 0 | 0 | 0 | 0 |
| "Makrolon 5705" polycarbonate | 29.70 | 26.82 | 29.70 | 26.17 | 121.5 | 53.64 |
| Seed | 0.55 | 0.50 | 3.30 | 2.91 | 1.13 | 0.50 |
| Polyester of DMT/EG/NPG* | 2.20 | 1.99 | 2.20 | 1.94 | 4.50 | 1.99 |
| 4-((4-Dimethylaminophenyl)2,6-di phenyl) 6-phenylthiapyrylium hexafluorophosphate | 3.52 | 3.18 | 3.52 | 3.10 | 7.20 | 3.18 |
| 4-(4-Dimethylaminophenyl)2-(4-ethoxyphenyl) 6-phenylthiapyrylium tetrafluoroborate | 0.88 | 0.79 | 0.88 | 0.78 | 1.80 | 0.79 |
| Tri-4-tolylamine | 9.90 | 8.94 | 9.90 | 8.72 | 40.50 | 17.88 |
| 1,1-Bis(di-4-tolyl-aminophenyl)cyclohexane | 9.90 | 8.94 | 9.90 | 8.72 | 40.50 | 17.88 |
| 1,4-Bis(di-4-tolyl-aminostyryl)benzene | 9.90 | 8.94 | 9.90 | 8.72 | 0 | 0 |
| 1,1-Bis(di-4-tolyl- aminophenyl) 3-n-propylbenzene | 9.90 | 8.94 | 9.90 | 8.72 | 0 | 0 |
| 4,4'-Bis(diethylamino) tetraphenylmethane | 4.40 | 3.97 | 4.40 | 3.88 | 9.00 | 3.97 |
| DC-510,phenylmethyl substituted siloxane | 0.20 | 0.18 | 0.20 | 0.17 | 0.40 | 0.18 |
| Dichloromethane | 623 | | 623 | | 1592.5 | |
| 1,1,2-Trichloroethane | 267 | | 267 | | 682.5 | |
| Total Solids | 110.75 | 11.07 | 113.50 | 11.00 | 226.53 | 9.00 |

*Dimethyl terephthalate - ethyleneglycol - neopentylglycol

We claim:

1. An electrophotographic element comprising a single photoconductive layer on an electrically conductive support wherein said photoconductive layer comprises (1) an aggregate photoconductive material comprising a continuous, electrically insulating polymer phase and heterogeneously dispersed therein a complex of (i) at least one polymer having an alkylidenediarylene group in a recurring unit and having a molecular weight greater than about 100,000 polystyrene equivalents, and (ii) at least one pyrylium dye salt, the concentration of said dye salt being less than about 6 weight percent of the aggregate material and (2) at least three organic charge transport agents, and said element having a surface with a 20° gloss measurement value greater than about 6.

2. An electrophotographic element of claim 1 wherein said polymer has a number average molecular weight of at least about 150,000 polystyrene equivalents, the concentration of pyrylium dye salt is from about 0.5 to 4 weight percent, and said photoconductive layer contains at least five organic charge transport agents.

3. The element of claim 2 wherein said polymer is bisphenol A polycarbonate and said pyrylium dye salt is a thiapyrylium dye salt.

4. The element of claim 3 wherein said thiapyrylium dye salt is 4-((4-dimethylaminophenyl)-2, 6-diphenyl)-6-phenylthiapyrylium hexafluorophosphate or 4-(4-dimethylaminophenyl)-2-(4-ethoxyphenyl)-6-phenylthiapyrylium tetrafluoroborate.

5. The element of claim 4 wherein the layer also contains pigment particles.

6. The element of claim 4 wherein the layer contains the organic charge transport agents tri-4-tolylamine, 1,1-bis(di-4-tolylaminophenyl)cyclohexane, 1,4-bis(di-4-tolylaminostyryl)benzene, 1,1-bis(di-4-tolylaminophenyl)-n-propylbenzene, or 4,4'-bis(diethylamino)tetraphenylmethane.

7. The element of claim 6 wherein the electrically conductive support has a cylindrical surface.

8. An element according to claim 1 which additionally comprises a thin, smooth overcoat of silicon carbide, the thickness of the overcoat being less than about 0.3 μm, and said element having a surface with a 20° gloss measurement value greater than about 6.

9. A method of forming a photoconductive element having a single aggregate photoconductive layer on an electrically conductive support which comprises forming a mixture comprising (1) particles of an aggregate photoconductive seed composition, (2) a plurality of binder polymers, at least one of which is an aggregating polycarbonate, (3) an aggregating pyrylium dye salt, (4) at least one organic charge transport agent, (5) a coating aid, and (6) a volatile coating solvent, coating and drying said mixture on said support, the concentration of said seed composition being from about 0.5 to 5 weight percent of said mixture and the concentration of pyrylium dye being less than about 6 weight percent of said mixture, thereby forming a smooth aggregate photoconductive layer having a 20° gloss measurement value of at least about 6.

10. The method of claim 9 which comprises forming an initial mixture comprising particles of an aggregate photoconductive seed composition, said binder polymers and said coating solvent and thereafter adding to said initial mixture an aggregating thiapyrylium dye salt, at least one organic charge transport agent and a coating aid to form a coating mixture.

11. The method of claim 10 wherein the coating mixture contains at least three organic charge transport agents, the concentration of seed composition is from about 1.5 to about 3 weight percent and less than about 4 weight percent of aggregating pyrylium dye salt.

12. The method of claim 9 wherein a thin layer of silicon carbide is vacuum deposited on the smooth aggregate layer to form a silicon carbide surface layer having a 20° gloss measurement value of at least about 6.

* * * * *